US011104489B2

(12) United States Patent
McBride et al.

(10) Patent No.: US 11,104,489 B2
(45) Date of Patent: Aug. 31, 2021

(54) ANNULAR SEAL HAVING A GARTER SPRING FOR ESTABLISHING A MINIMUM INTERIOR DIAMETER AND SEAL PLUG INCLUDING THE SEAL

(71) Applicant: Aktiebolaget SKF, Gothenburg (SE)

(72) Inventors: Tadd McBride, Riverton, UT (US); Ryan Higgins, Sandy, UT (US)

(73) Assignee: AKTIEBOLAGET SKF, Gothenburg (SE)

( * ) Notice: Subject to any disclaimer, the term of this patent is extended or adjusted under 35 U.S.C. 154(b) by 334 days.

(21) Appl. No.: 16/034,540

(22) Filed: Jul. 13, 2018

(65) Prior Publication Data

US 2020/0017259 A1 Jan. 16, 2020

(51) Int. Cl.
*B65D 39/00* (2006.01)

(52) U.S. Cl.
CPC ..... *B65D 39/0005* (2013.01)

(58) Field of Classification Search
CPC ..... B65D 39/0005; B65D 41/0435; F16J 15/3204; F16J 15/3212; F16J 15/3232; E02D 29/149
See application file for complete search history.

(56) References Cited

U.S. PATENT DOCUMENTS 2,614,869 A * 10/1952 Smith ..... F16J 15/3232 277/565
3,523,692 A * 8/1970 Otto ..... F16J 15/3456 277/366
3,692,318 A * 9/1972 Day ..... F16J 15/3212 277/554
3,806,137 A * 4/1974 Prasse ..... F16J 9/206 277/468
3,827,703 A * 8/1974 Brink ..... F16J 15/3212 277/553
3,892,418 A * 7/1975 Felt ..... F16J 15/3236 277/560
3,941,396 A * 3/1976 Bailey ..... F16J 15/3204 277/505
4,750,748 A * 6/1988 Visser ..... B63H 23/321 277/561
5,667,225 A * 9/1997 Vollmer ..... F16J 15/3232 277/563
6,293,558 B1 * 9/2001 Crapart ..... F16J 15/006 277/551
2005/0073110 A1 * 4/2005 Armour ..... F16J 15/3224 277/549
2008/0079222 A1 * 4/2008 Namuduri ..... F16J 15/3212 277/359
2008/0122181 A1 * 5/2008 Grimanis ..... F16J 15/40 277/308
2009/0108540 A1 * 4/2009 Kolb, Jr. ..... F04D 29/102 277/562

(Continued)

*Primary Examiner* — Eugene G Byrd
(74) *Attorney, Agent, or Firm* — J-TEK Law PLLC; Scott T. Wakeman; Mark A. Ussai

(57) ABSTRACT

An annular seal element includes a seal body having a radially inner surface and at least one seal lip extending radially outward from the seal body. There is an open, radially inwardly facing circumferential channel in the radially inner surface and a garter spring is disposed entirely within the circumferential channel. Also, a seal plug including the annular seal element.

12 Claims, 4 Drawing Sheets

(56) References Cited

U.S. PATENT DOCUMENTS

| | | | | |
|---|---|---|---|---|
| 2012/0134613 | A1* | 5/2012 | Schweitzer | F16C 33/7876 384/484 |
| 2013/0119011 | A1* | 5/2013 | Kawachi | B65D 39/00 215/355 |
| 2013/0213924 | A1* | 8/2013 | Vrijens | B65D 39/0005 215/355 |
| 2018/0058585 | A1* | 3/2018 | Sato | F16J 15/3216 |
| 2018/0163580 | A1* | 6/2018 | Kishiro | F01L 3/08 |
| 2019/0107166 | A1* | 4/2019 | Whitford | F16F 3/04 |
| 2019/0346045 | A1* | 11/2019 | Grant | F16J 15/3212 |

* cited by examiner

ANNULAR SEAL HAVING A GARTER SPRING FOR ESTABLISHING A MINIMUM INTERIOR DIAMETER AND SEAL PLUG INCLUDING THE SEAL

TECHNOLOGICAL FIELD

The present disclosure is directed to an annular seal having a garter spring for setting a minimum internal diameter and a seal plug including such a seal.

BACKGROUND

It is often necessary to seal a cylindrical opening with a plug that is mounted in the opening with a friction fit. To this end, the plug may be provided with an annular seal member that projects radially outward and forms a seal with the internal surface of the cylindrical opening. Difficulties may arise when the plug, referred to hereinafter as a "seal plug," is exposed to a wide range of temperatures and/or used in cylinders with interior diameters that are not made to close tolerances. This is because at low temperatures, the annular seal member may contract and pull away from the internal surface of the opening so that it no longer forms a seal therewith.

Underground storage tanks, such as the tanks found at most gas stations in the United States, include a vertical riser extending from the tank to an opening in the ground surface above the tank. A fuel delivery hose can be connected to the top end of the riser to transfer fuel (e.g. gasoline, diesel fuel, kerosene or any other liquid storable in an underground storage tank) from the truck into the tank in a manner that minimizes spillage and the release of volatile fumes to the environment.

While seal plugs can be used in many types of pipes and other cylindrical openings, a particular use for a seal plug is in the access opening around the riser of an underground storage tank. Seal plugs used in this environment may be formed with a hollow interior so that they are bucket shaped and may catch debris that falls into the access opening that is being sealed. Such seal plugs may therefore be referred to as "buckets" or "debris buckets."

Furthermore, in order to catch small spills that occur during the filling of an underground storage tank, a spill prevention bucket is generally located at the top of each riser with a top approximately flush with the ground and a bottom about 6 to 12 inches below the top which bottom is sealed to the riser. Any fuel spilled during the filling process is caught by the spill prevention bucket and prevented from seeping into the soil surrounding the riser. Some spill prevention buckets include openings that guide spilled fuel to the riser and to the tank interior; others merely trap the fuel so that it can be absorbed or otherwise recovered. Each spill prevention bucket and riser is generally covered by a cover sufficiently strong to support the weight of cars and trucks driving thereover; these are the covers that are typically seen in the paved areas surrounding pumps at gas stations.

Problems occur when water, dirt, leaves and other environmental debris enter the spill prevention bucket. Water, for example, may leak through openings in or at the edges of the cover. Leaves, dirt, etc., may also fall into the spill prevention bucket when the cover is removed. If the spill prevention bucket is in fluid communication with the riser to allow spilled fuel to drain into the underground storage tank, these contaminants may also enter the underground storage tank and contaminate the fuel therein. It is therefore known to mount a seal plug or debris collection bucket inside the spill prevention bucket to catch contaminants before the reach the spill prevention bucket. In this manner, the only substance that should ever be present in the spill prevention bucket is spilled fuel.

If a spill prevention bucket is not provided on a particular underground storage tank, debris could fall directly into the tank when the cover is removed. In such cases, a seal plug/debris bucket could be mounted directly between the riser and the side wall of the opening through which the riser is accessed or even in the interior of the riser itself.

Conventional seal plugs that are configured to function as debris buckets have a bottom opening that fits over a riser, a side wall extending from the bottom wall and a top edge having a seal that frictionally engages the inner wall of the spill prevention bucket near the top of the spill prevention bucket (or the cylindrical sleeve surrounding the riser at ground level or the riser itself if no spill prevention bucket is present). However, seal plugs and their seal elements will be exposed to large temperature fluctuations over the course of a year, for example, from more than 20 degrees below zero Fahrenheit at some locations in winter to over 140 degrees Fahrenheit when surrounded by a hot asphalt surface in summer.

It is difficult to provide a sealing arrangement that maintains an adequate seal between the seal plug and the spill prevention bucket or other cylindrical sleeve in which it is mounted because the elastomers used to form a seal element may have a coefficient of thermal expansion many times greater than that of the metal components around the seals. Therefore, at very low temperatures, the seal elements tend to shrink more than the metal sleeves in which they are mounted and pull away from the metal sleeves thus leaving a gap between the radially outer portion of the seal element and the sleeve through which water and/or debris can pass. In the past, attempts to address this problem have involved the use of radially larger seal elements. These larger seal elements may provide adequate sealing at low temperatures, but at high temperatures, they may expand to such an extent that the seal plug sticks in the opening and cannot be removed. In the alternative, the expanding seal element may damage or deform the seal plug itself which can also prevent the seal plug from performing its sealing and debris blocking/collecting function.

These problems are aggravated by the fact that the openings in which seal plugs are mounted, while nominally having the same internal diameter, often vary somewhat in size. A given seal plug therefore must be able to form and maintain a seal with the interior of a spill prevention bucket or other sleeve that has a range of diameters while maintaining an adequate seal over a wide range of operating temperatures.

SUMMARY

These problems and others are addressed by embodiments of the present disclosure, a first aspect of which comprises a seal plug that has a plug body with a top, a bottom, and a cylindrical or truncated-cone shaped side wall extending from the top to the bottom, the side wall having an upper end adjacent the top and a lower end adjacent the bottom. The plug body has a radially outwardly facing groove at the upper end of the side wall, and the groove has a bottom and first and second sides extending radially outwardly from the groove bottom. There is an annular seal element in the groove that comprises a seal body having a radially inner surface facing the groove bottom and at least one seal lip extending radially outward from the seal body and from the groove. There is also a circumferential channel in the radially inner surface of the annular seal element and a garter spring in the circumferential channel and in the groove.

Another aspect of the disclosure comprises an annular seal element including a seal body having a radially inner surface and at least one seal lip extending radially outward from the seal body. There is an open, radially inwardly facing circumferential channel in the radially inner surface of the annular seal element, and a garter spring is disposed entirely within the circumferential channel.

Yet another aspect of the disclosure comprises a seal plug having a side wall having an open upper end, an open lower end and a circular cross section. There is a radially outwardly facing groove at the upper end that has a bottom and first and second sides extending radially outwardly from the groove bottom. The plug includes an annular seal element in the groove that has a seal body with a radially inner surface facing the groove bottom and at least one seal lip extending radially outward from the seal body and from the groove. There is a circumferential channel in the annular seal element and a zero-gap garter spring in the circumferential channel and in the groove.

BRIEF DESCRIPTION OF THE DRAWINGS

These benefits and others will be better appreciated after a reading of the following detailed description of an embodiment of the invention together with the attached drawings in which.

DETAILED DESCRIPTION

Figure 1:
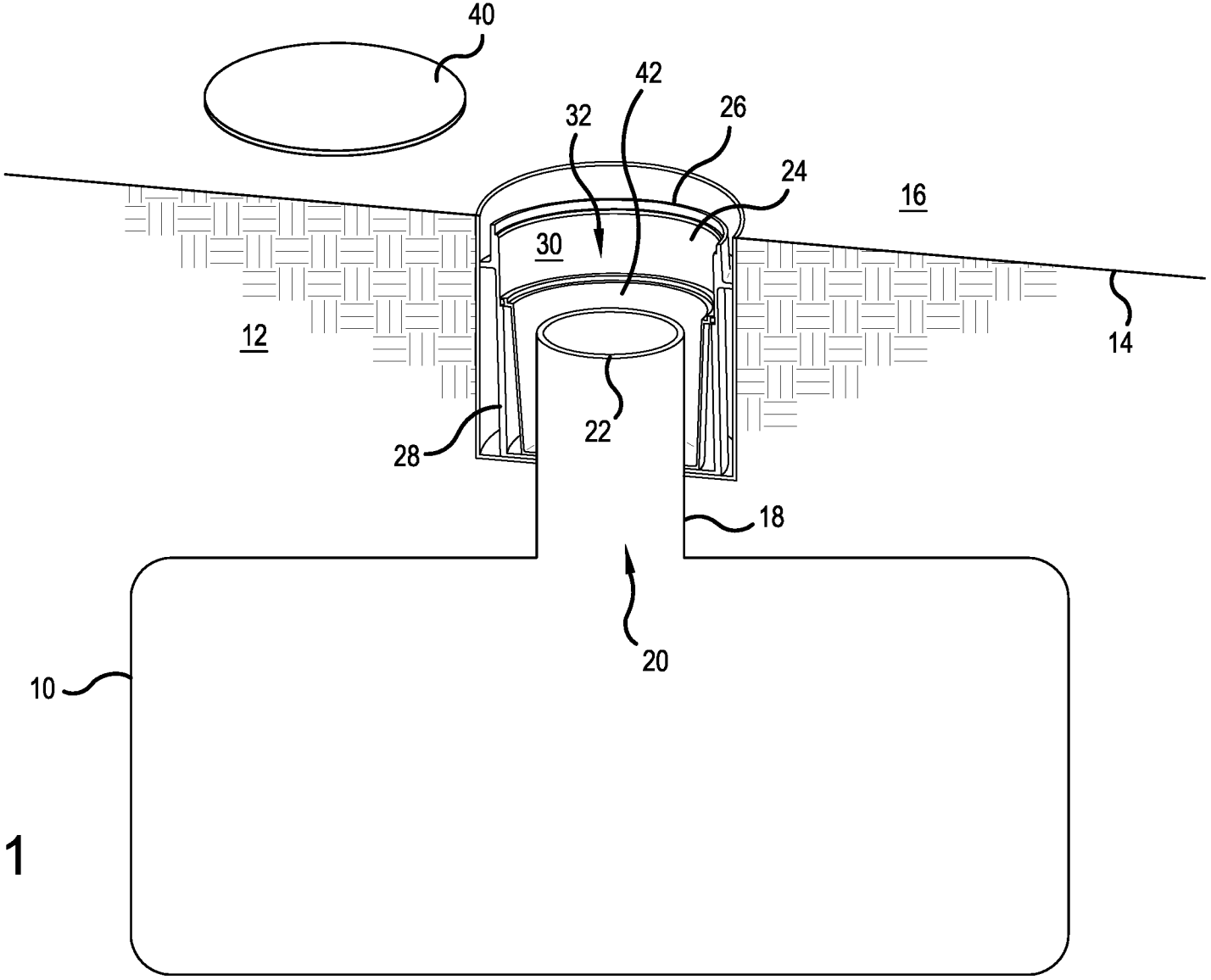
FIG. 1 is schematic sectional side elevational view of an underground storage tank and a riser extending to near the surface of the ground over the tank with a spill prevention bucket mounted at the top of the riser and a seal plug according to an embodiment of the disclosure in the spill prevention bucket.

Referring now to the drawings, wherein the showings are for purposes of illustrating an embodiment of the disclosure only and not for limiting same, FIG. 1 shows an underground storage tank 10 buried in the ground 12 beneath a pavement layer 14 having an upper surface 16. A riser 18 extends upward from the storage tank 10 and has a bottom opening 20 at the storage tank 10 and an upper opening 22 a short distance beneath the upper surface 16. The storage tank 10 can be filled with a liquid, for example a fuel such as gasoline or diesel, by connecting a hose (not illustrated) between a tank truck (not illustrated) and the upper opening 22 of the riser.

A spill prevention bucket 24 is provided at the top of the riser 18. The spill prevention bucket has a top opening 26 and a side wall 28 that has an interior surface 30 that partially defines an interior 32 of the spill prevention bucket 24 and a shoulder 34 projects radially inward from the interior surface 30. The spill prevention bucket 24 also has a bottom wall 36 with an opening 38 that allows the spill prevention bucket 24 to be mounted over the riser 18. A cover 40, illustrated in FIG. 1 on the ground next to the riser opening, is removably mountable at the top opening 26 of the spill prevention bucket 24.

A removable seal plug 42 is mounted in the interior 32 of the spill prevention bucket 24 to collect water and other debris and prevent it from reaching the interior of the spill prevention bucket 24. Because the disclosed embodiment of the seal plug 42 has a hollow interior, the seal plug 42 will function as a bucket which will retain accumulated debris when the seal plug 42 is lifted out of the spill prevention bucket 24. Seal plugs of this type are therefore sometimes referred to as "debris buckets" or "debris collection buckets."

Figure 2:
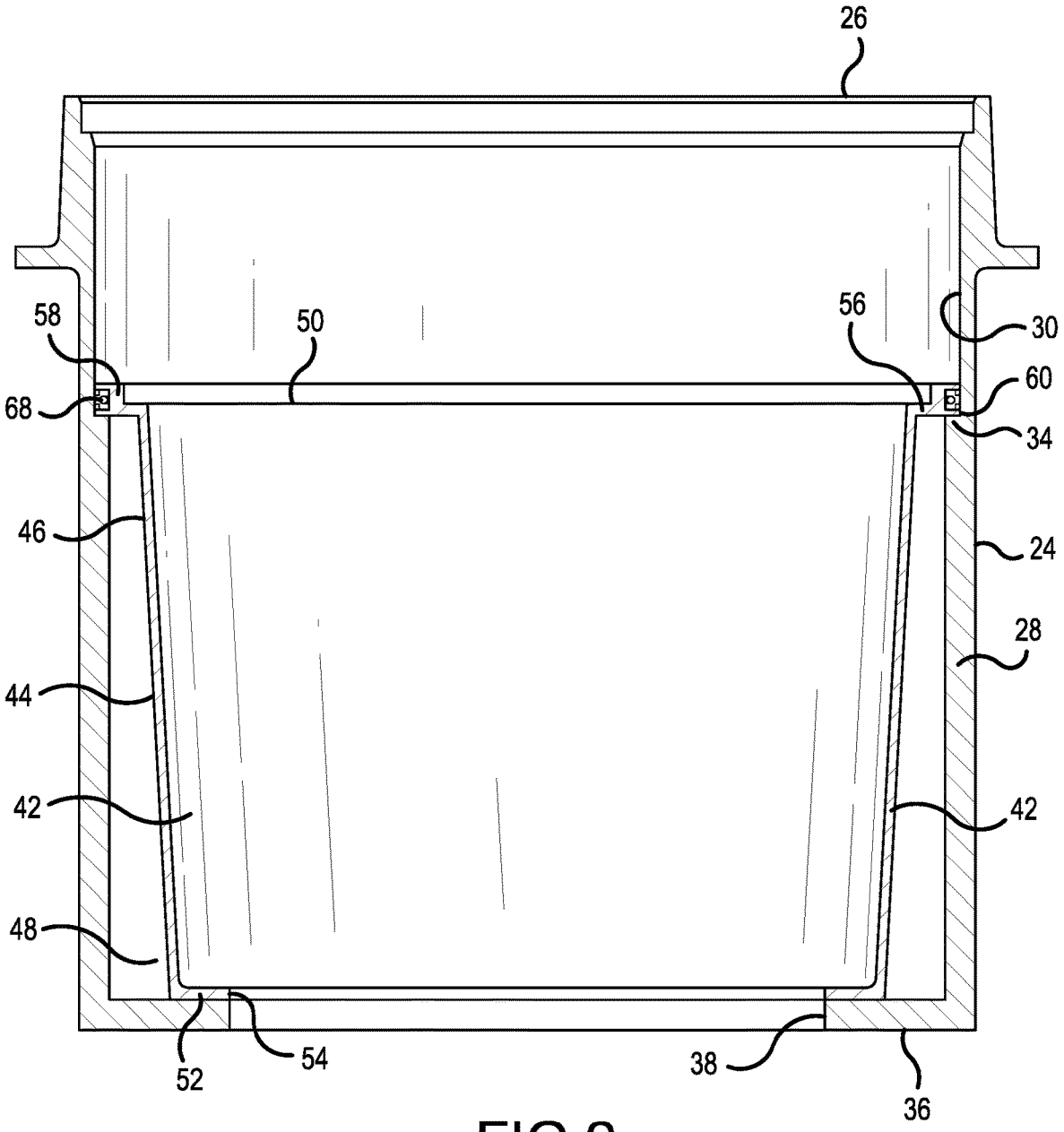
FIG. 2 is a sectional side elevational view of the seal plug and its seal element in the spill prevention bucket of FIG. 1.
Figure 3:
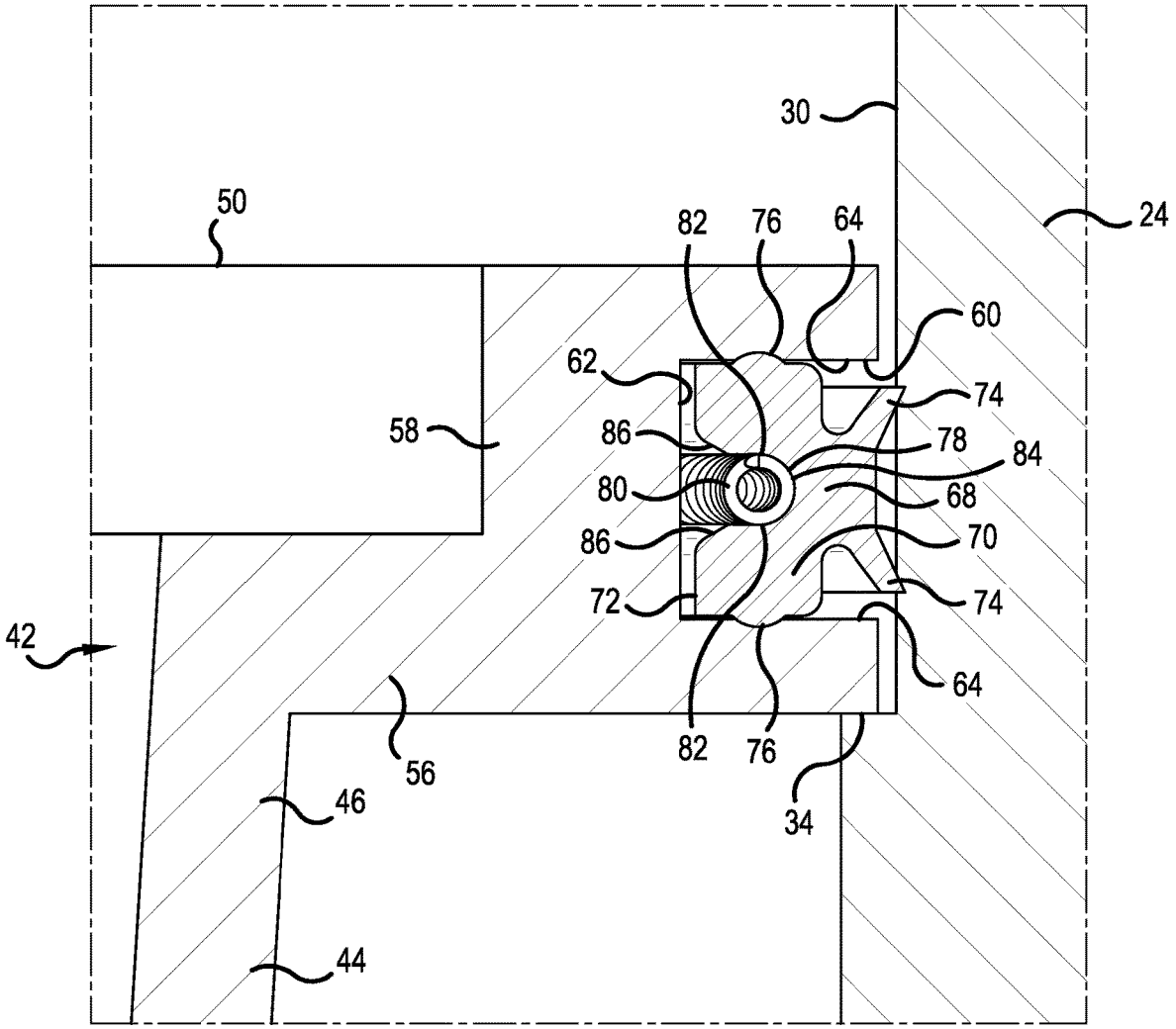
FIG. 3 is a detail view of the upper edge of the seal plug and seal element of FIG. 2.

Referring now to FIGS. 2 and 3, the seal plug 42 has the shape of a truncated cone with a tapered side wall 44 that has a top 46 and a bottom 48. The seal plug 42 further includes a top opening 50 and a bottom wall 52 that projects radially inward from the bottom 48 of the side wall 44 and that has an opening 54 configured to accommodate a riser 18 over which the seal plug 42 can be installed. A flange 56 projects radially outward from the top 46 of the tapered side wall 44. An annular body 58 is mounted or integrally formed at the radially outer edge of the flange 56, and a radially outwardly facing groove 60 is formed in the annular body 58. The groove 60 has a bottom 62, first and second sides 64 and is open in a radially outward direction.

Figure 4:
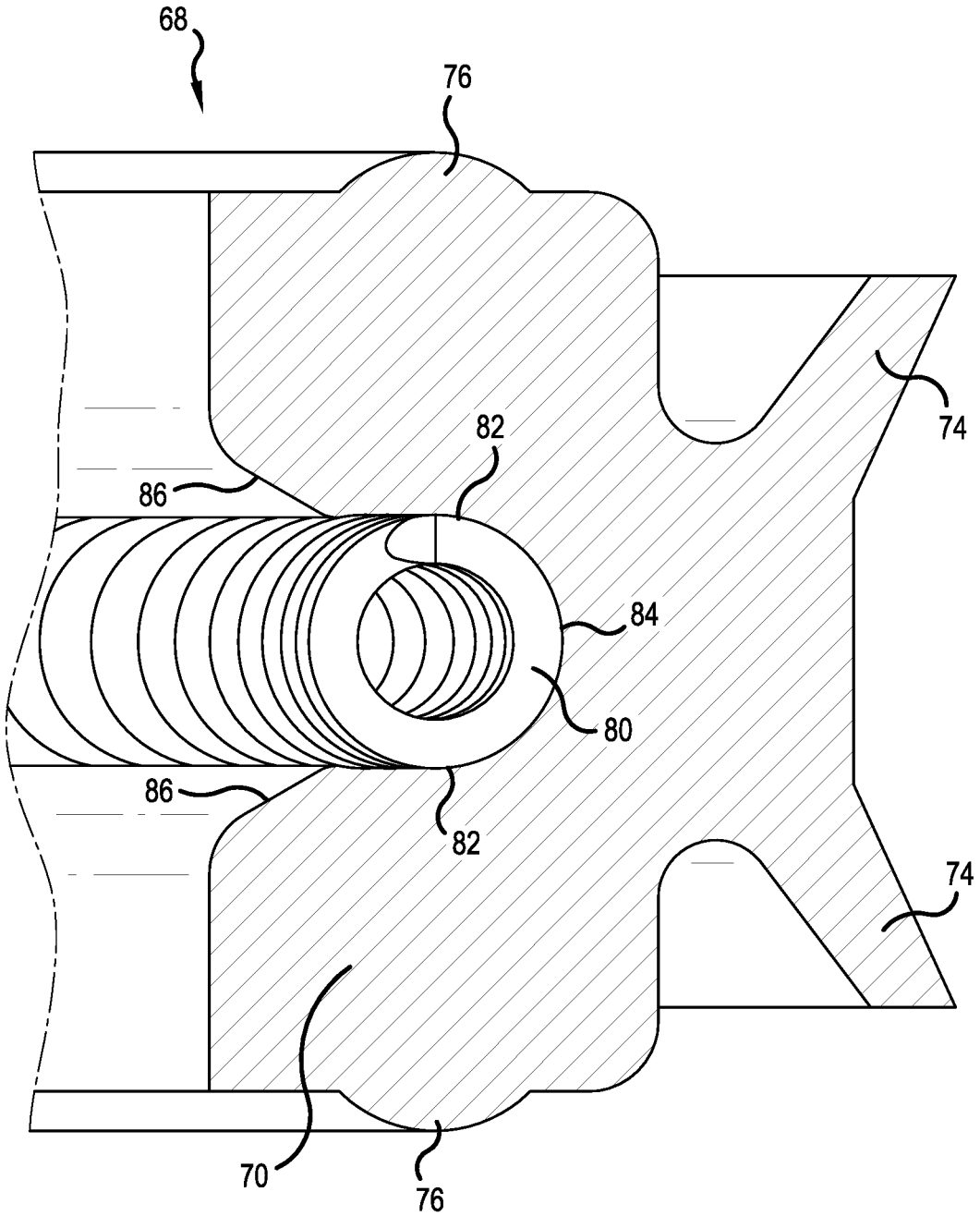
FIG. 4 is radial sectional view of the seal element of FIG. 2.

An annular seal element 68 is mounted in the groove 60, and the seal element 68 (shown removed from the grove 60 in FIG. 4) comprises a seal body 70 with a radially inner surface 72 facing the bottom 62 of the groove 60 and first and second seal lips 74 that project radially outwardly from the seal body 70 and are configured to sealingly engage the interior surface 30 of the spill prevention bucket 24 and maintain a seal with the interior surface 30 when the seal plug 42 is mounted therein. First and second protrusions 76 on the axially upper and lower sides of the seal body 70 contact the first and second sides 64 of the groove 60 and are configured to slide radially along the sides 64 to allow the seal element 68 to float radially in the groove 60.

The radially inner surface 72 of the seal body 70 has a circumferential channel 78 in which a garter spring 80 is mounted. The channel 78 is open in a radially inward direction and has first and second sides 82 and a bottom 84, and the sides 82 connect to the radially inner surface 72 of the seal body 68 at two angled wall portions 86 which may sometimes be referred to as "chamfers."

The garter spring 80 has a predetermined minimum internal diameter when it is in a "zero-gap" state, that is, a state in which all circumferentially adjacent coils of the garter spring are in contact with each other such that the internal diameter of the garter spring 80 cannot be further reduced. When mounted in the channel 78, the garter spring 80 thus also defines a minimum internal diameter for the seal element 68 because the seal element 68 will be prevented from contracting by the fixed diameter of the garter spring 80.

As used herein, a "rest state" of a spring is a state in which no external radial forces are applied against the spring and the spring is applying no radial forces against an external body. The zero gap state can occur when an expansion garter spring is fully contracted or in its rest state. A zero gap state can also exist when a compression garter spring, one with gaps between circumferentially adjacent coils when in a rest state, is compressed to the point that all circumferentially adjacent coils of the spring are in contact with each other. Thus a compression garter spring can be held in a zero-gap state by a radial inward force. Both a fully contracted expansion garter spring and a compression garter spring held in a zero-gap state by a radially inwardly acting force may be described as a "zero-gap garter spring."

When the garter spring 80 is mounted in the channel 78, no portion thereof projects from the channel, and when the seal element 68 is mounted in the groove 60, the garter spring 80 is spaced from the groove bottom 62. The garter spring 80 thus functions to establish a minimum inner diameter of the annular seal element 68 because the diameter of the spring cannot be further decreased (in the case of a zero-gap or fully contracted expansion spring) or can be decreased only slightly until the zero-gap state is reached (in the case of a compression garter spring). Thus, as noted previously, even though the coefficient of thermal expansion of the elastomer from which the seal element 68 is formed is many times greater than that of the surrounding materials, the metallic garter spring 80, which cannot be non-destructively compressed to have a diameter less than a predetermined minimum, will set the smallest diameter of the seal body 68 and therefore prevent the seal lips 74 from pulling away from the inner surface 30 of the spill prevention bucket 24 even at very low temperatures while not interfering with the expansion of the seal element 68 either at higher temperatures or when the seal element 68 is radially stretched over the annular body 58 to place it into the groove 62 during the assembly of the seal plug 42.

In use, the elastomer seal body 68 is formed by conventional techniques so that it includes a channel 78, and a garter spring 80 having a predetermined minimum inner diameter, e.g., in its zero-gap state, is mounted in the channel 80. The seal body 68 and garter spring 80 are then stretched around the top of the annular body 58 and allowed to contract into the groove 60 with the first and second protrusions 76 in contact with the first and second sides 64 of the groove 60 and the first and second seal lips 74 extending from the groove 60. The seal plug 42 with the seal body 68 is then inserted into a spill prevention bucket 42 by sliding the seal lips 74 axially along the inner surface 30 of the spill prevention bucket 24 until the axial body 58 contacts the shoulder 34 and stops further movement of the seal plug 42. The cover 40 is placed into position on the top of the spill prevention bucket 24. Over time, water, dirt, leaves and other debris may enter beneath the cover 40 and collect in the interior 32 of the seal plug 42. When it becomes necessary to refill the underground storage tank 10, the cover 40 is removed, and the seal plug 42 (acting as a debris collection bucket) is pulled from the spill prevention bucket 24 leaving behind a spill prevention bucket 24 that is free from debris. After the tank 10 is filled, the seal plug 42 is cleaned and replaced in the spill prevention bucket 24, and the cover 40 is replaced.

The present invention has been described herein in terms of a preferred embodiment. However, modifications and additions to this invention will become apparent to persons of ordinary skill in this field upon a reading of the foregoing description. For example, the seal plug 42 only requires an open interior 30 when it is used as a debris collection bucket. When debris collection is not required, the seal plug 42 could include a top wall and/or a closed interior. It is intended that all such modifications and additions form a part of the present invention to the extent they fall within the scope of the several claims appended hereto.

What is claimed is:

1. An annular seal element comprising:

a seal body having a radial inner surface and at least one seal lip extending radially outward from the seal body, the annular seal element including an open, radially inwardly facing circumferential channel in the radially inner surface; and a zero-gap garter spring disposed entirely within the circumferential channel;

wherein the seal body further has two opposing axial sides and at least one protrusion extending outwardly from one of the two axial sides of the seal body and configured to seal against a radial surface.

2. The annular seal element according to claim 1, wherein the garter spring is in a rest state.

3. The annular seal element according to claim 1, wherein the entire garter spring is located radially outwardly of the radially inner surface.

4. The annular seal element according to claim 1, wherein the garter spring has a fixed diameter and is configured to prevent contraction of the seal body.

5. The annular seal element according to claim 1, wherein the circumferential channel extends radially outwardly from the radially inner surface of the seal body.

6. The annular seal element according to claim 1, wherein the seal body has a radially outer surface and the at least one seal lip extends radially outwardly from the radially outer surface of the seal body and is configured to seal against an inner circumferential surface.

7. The annular seal element according to claim 1, wherein the seal body has two opposing axial sides and is configured to be mounted within an annular groove with the two sides disposed within the groove, each one of the at least one seal lip being located axially between the two axial sides of the seal body.

8. An annular seal element comprising:

a seal body having a radially inner surface, a radially outer surface, at least one seal lip extending radially outwardly from the radially outer surface of the seal body, and a circumferential channel formed in the seal body so as to extend radially outwardly from the radially inner surface; and a zero-gap garter spring disposed within the circumferential channel and having a fixed diameter such that spring prevents radially inward contraction of the seal body;

wherein the seal body further has two opposing axial sides and at least one protrusion extending outwardly from one of the two axial sides of the seal body and configured to seal against a radial surface.

9. The annular seal element according to claim 8, wherein the garter spring is in a rest state.

10. The annular seal element according to claim 8, wherein the entire garter spring is located radially outwardly of the radially inner surface.

11. The annular element according to claim 8, wherein the at least one seal lip is configured to seal against an inner circumferential surface.

12. The annular seal element according to claim 8, wherein the seal body has two opposing axial sides and is configured to be mounted within an annular groove with the two sides disposed within the groove, each one of the at least one seal lip being located axially between the two sides of the body.

* * * * *